United States Patent [19]

Levine

[11] Patent Number: 4,483,658

[45] Date of Patent: Nov. 20, 1984

[54] ROTATIONAL WAKE REACTION STEPS FOR FOILS

[76] Inventor: Elliott M. Levine, 393 Kingston Crescent, Winnipeg, Manitoba, Canada, R2M 0T7

[21] Appl. No.: 355,227

[22] Filed: Mar. 5, 1982

Related U.S. Application Data

[63] Continuation-in-part of Ser. No. 102,398, Dec. 11, 1979, , which is a continuation-in-part of Ser. No. 844,723, Oct. 25, 1977, abandoned, which is a continuation-in-part of Ser. No. 714,387, Aug. 16, 1976, abandoned.

[51] Int. Cl.[3] ..... B64C 11/48

[52] U.S. Cl. ..... 416/130; 416/127; 416/200 R

[58] Field of Search ..... 416/121, 120, 124, 127, 416/198 R, 130, 200 R, 200 A; 415/68, 199.4, 199.5

[56] References Cited

U.S. PATENT DOCUMENTS

| | | | |
|---|---|---|---|
| 1,073,413 | 9/1913 | Faehrmann | 416/200 |
| 1,610,689 | 12/1926 | Kögler | 416/200 R X |
| 2,407,630 | 9/1946 | Dewan | 416/127 X |
| 2,619,318 | 11/1952 | Schaer | 416/200 A |
| 2,717,044 | 9/1955 | Kubota | 416/200 |
| 2,906,447 | 9/1959 | Seed | 416/200 A X |
| 2,982,361 | 5/1961 | Rosen | 416/120 X |
| 3,023,813 | 3/1962 | Fengler | 416/124 |
| 3,153,454 | 10/1964 | Gaubis | 416/127 |
| 4,306,839 | 12/1981 | Pien | 416/200 R |

FOREIGN PATENT DOCUMENTS

| | | | |
|---|---|---|---|
| 232130 | 11/1959 | Australia | 416/124 |
| 1503647 | 3/1969 | Fed. Rep. of Germany | 416/130 |
| 465764 | 9/1951 | Italy | 416/200 |
| 146276 | 11/1980 | Japan | 416/130 |
| 251987 | 9/1948 | Switzerland | 416/200 |
| 916310 | 1/1963 | United Kingdom | 416/127 |

*Primary Examiner*—Everette A. Powell, Jr.

[57] ABSTRACT

The action of upstream and downstream foil sets rotating on a common shaft within a fluid is enhanced by fixing certain interrelations of the foils such as the axial distance between the foils, the radial index between foils and pitch of one foil relative to the other so that the foil stages are fixedly mounted with the foils of each stage being symmetrically and equidistantly spaced from one another and from the foils of the next adjacent foil stage so that the interacting uniform adjacent foil pressures and the upstream foil wake beneficially interacts optimally with at least one of the surfaces or boundary layers of the foils of the next adjacent downstream foil stage.

28 Claims, 6 Drawing Figures

ROTATIONAL WAKE REACTION STEPS FOR FOILS

This application constitutes a continuation-in-part of Ser. No. 102,398 filed Dec. 11, 1979, which is a continuation-in-part application of Ser. No. 844,723, filed Oct. 25th, 1977, now abandoned, which in turn is a continuation-in-part application of application Ser. No. 714,387, filed Aug. 16th, 1976, and now abandoned.

BACKGROUND OF THE INVENTION

This invention relates to a system for fixing co-rotating axial flow blades with twist and staged so that both wake interceptions for a variety of relative velocities and, adjacent equidistant blade spacing are realized so as to provide acoustic and/or efficiency benefit.

Given that blades with twist, tending to uniform advance in axial flow, normally produce swirling wake sheets, one for each blade. And given that each propagation generally represents swirling energy loss and a source of noise radiation. And given that co-rotating discs of blades with roots fixed to a common axis of rotation and with uniformly advancing swirling wakes of upstream blades that are substantially capable, when staged, of intercepting or interacting with downstream blades.

While such interactions are generally thought to be detrimental, if all other things are equal, it seems desirable to reduce net wake production. By equidistantly spacing separate blades in adjacent stages coincident with effective near wake interception the invention realizes a complex of beneficial wake interactions hitherto unsuspected. Virtual wake reduction here realizes an acoustic benefit. Many acoustic reduction systems incurring general efficiency losses are known, and despite the general belief that wake interactions are detrimental, it is a feature of this invention that increased efficiency is realized whereby some of the energy of the swirling wakes is harnessed to beneficially work upon the following blades under a range of some practical conditions.

That is, by critically locating uniformly advancing co-rotating staged blades to realize the synergizing complex of interactions described herein, the sum of the blades can practically be made to produce less noise and/or to often act more energy efficiently than conventional single disc embodiments, or than any of the factors taken separately. In this specification and claims, synergy means that the combination of factors realizes benefits greater than any of the factors acting separately.

Historically, work by Eiffel Tietjens Prandtl and others has led erroneously to a general belief in the in efficiency of staged foils due to interactions thought detrimental. Nonetheless some others have noted special relative advantage of some co-rotating stage systems. Ward, U.S. Pat. No. 3,625,631 teaches avoidance of coplanar non-uniform blade wake interactions by variable geometry staging. Shipes, U.S. Pat. Nos. 3,768,546 and Rosen, 2,982,361 teach compact co-operation with devices that teach a substantial and essential zero net axial space between at least the first two discs of adjacent co-rating blade stages fixed to a common axis of rotation such that the rear element of the upstream blades substantially describe a disc common or adjacent to that described by the front element of the downstream blades.

That is to attain compact interactions these embodiments deliberately avoid planform symmetry/equidistant blade spacing yet such symmetry/equidistance, sacrificing maximum compactness, is the fixed variable required by the present invention to synergize blade phase absorption in the presence of near wake interception.

Rosen claims acute index advance angles specifically denying symmetrical planforms. Shipes et al index advance claims teach some interaction avoidance so as to fix angles, to show assymetrical, or more extreme alternate zero blade separation, planforms. The effective function of both these planform assymetries is to substantially approach or realize first stage blade frequency reinforcement, whereas the symmetrical/equidistant staged interacting planform can substantially approach first stage frequency reduction or cancellation.

I thus conclude that hitherto known co-rotating staged uniform wake-producing systems do not know, claim or have the capacity to realize specific performance superior to known conventional single stage configurations for axial flow fans and propellors, while non-uniform wake producing variably staged systems taught wake avoidance and deliberately and substantially lacked capacity for wake interception.

Thus no prior staged system has realized the complex or synergizing relations herein disclosed.

SUMMARY OF THE INVENTION

This invention relates to an improved geometry for fixing blade root locations for fans and propellors that operate with substantially uniform wake producing blades and multiple stages fixed to a common axis of rotation.

Any array of blades with at least two stages will initially generate a swirling wake, one for each blade, that represents energy loss and generates an acoustic signature, that can, because uniformly advancing, be intercepted by a downstream blade. In this case wakes will be shared or absorbed. Realistically, benefits exist for relatively slender blades and disappear as the slenderness ratio decreases. Such interception can also beneficially reload the system where the axial distance between the discs allows the free stream blades to handle an increased effective streamtube inflow or volume of fluid for added efficiency. Where the axial spacing is small or the inflow restricted, this latter effect is reduced, as in a duct, and the separate blades, if in interaction, tend to act as if they were a single compound, with some residual benefits in some ducted applications.

Where the blades are also relatively slender and somewhat distantly spaced, a second and complementary action is generated such that alternate blades interact to cancel or dampen the amplitude of their interacting partner to either side in adjacent disc(s). This is because as independent and equidistant, they are optimally spaced to neutralize the initial blade passing frequency of these partners. Thus it is useful for such blades to be substantially similar although some variation because of local operating condition may be found useful. At the same time however the initial set of wake spirals generated by the first or most upstream disc is virtually shared by the downstream disc blades. Thus instead of the conventionally high amplitude associated with the lowered blade passing frequency signature (and approached by alignment/near alignment configurations) we now have a condition whereby a given system of co-rotating blades cooperate to effect a self dampening acoustic system of virtually altered frequency while simultaneously increasing it's output efficiency for a range of load and velocity conditions.

It should be noted that systems effecting one but not both of these conditions, of swirl interception and symmetrical/equidistant spacing, critically fail to realize the benefits of the synergizing co-operation.

It is thus a purpose of this invention to sustain swirling wake near interceptions for co-rotating discs of uniform wake-producing equidistantly spaced blades to effect virtual wake frequency reduction often with increased efficiency due to blades reloading combined with increased effective inflow streamtube and/or sound reduction coincident with said near interception. This effect is sustained over a series of relative velocities and their vicinity for a given fixed set of foil roots as defined by the formula developed below. That is, a single configuration can be useful at least partially for a variety and range of relative velocities. Still air, or zero relative velocity is included though of course some consideration should be given to the immediate environment as it affects the free air stream. Increased efficiency benefit will be maximal for relatively low velocities and loadings. Residual benefits will hold for several ducted applications.

In accordance with the invention there is provided a rotary foil system acting upon a medium or fluid like air and rotating in the same direction comprising in combination at least two foil stages, an upstream foil stage and a downstream foil stage, an axis of rotation, said foil stages being fixedly mounted relative to said axis for common rotation, therewith and with one another and in the same direction, the foils of each stage being substantially equidistantly spaced from one another and from the foils of the next adjacent foil stage whereby substantially uniform pressures are produced, so that the interacting uniform adjacent foil pressures and the upstream foil wake beneficially interacts optimally with at least one of the surfaces or boundary layers of the foils of the next adjacent downstream foil stage to a distance beyond which benefit ceases.

With the foregoing in view and other advantages as will become apparent to those skilled in the art to which this invention relates as this specification proceeds, the invention is herein described by reference to the accompanying drawings forming a part hereof, which includes a description of the preferred but not limiting typical embodiment of the principles of the present invention, in which:

BRIEF DESCRIPTION OF THE DRAWINGS

In the drawings like characters of reference indicate corresponding parts in the different figures.

DETAILED DESCRIPTION

Considering first the general case for substantially uniform wake producing axial flow blades fixed to a common axis of rotation. For a single stage rotating disc of N blades the critical blade passage frequency (B.P.F.), or maximum sound output, will occur at N times revolutions over time interval, as in FIG. 5-*l*. An increase, for example, a doubling, of initial blade numbers will realize cancellation/substitution of the original B.P.F. and produce a new B.P.F. of 2N with a lower sound output for a common/constant energy input, as in FIG. 5-*m*. Unfortunately the number of swirling wakes has been doubled to 2N in this case. The doubling of the frequency generally is accompanied by a reduction in amplitude energy or load (see FIGS. 5-*l* and 5-*m;* o vs p) of each of the beats that along with lowered tip velocity conventionally effects some acoustic benefit. Incremental area "r" with amplitude p, while large compared to 5-*n* is generally acceptable and masked for 5-*l* of amplitude o.

If we now consider the case for n discs where additional foils N, per disc, are staged downstream in subsequent disc(s) of rotation and upon the common shaft of rotation but with the index advance angle (I.A.) as determined by the following or like formaula: (360°/nN) that establishes substantially equidistant spacing of all blades in the system, we find a series of critical locations for placing the disc(s) where the N upstream swirling wakes will intercept the N downstream blade locations. These locations will have index advance angles amongst co-operating blades for small odd numbered values M times the I.A. as determined and illustrated herein for two staged embodiments.

Figure 6:
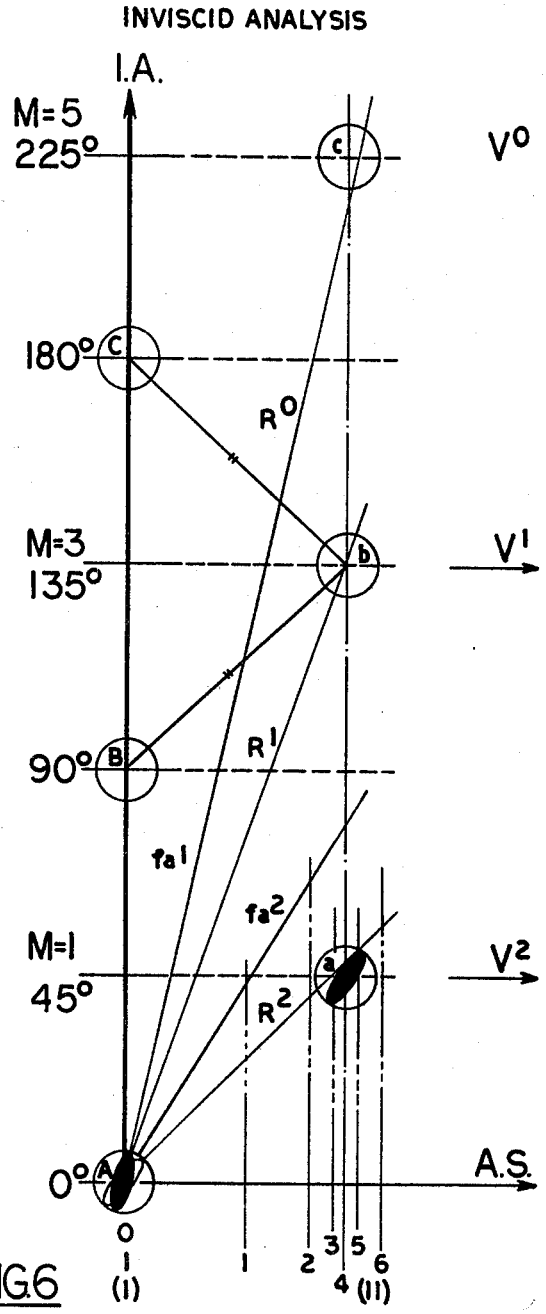
FIG. 6 shows critical typical inviscid analysis interactions, available from FIGS. 1 and 2, as determined by calculating angles and axial spaces given by the formulae given herein, for an inviscid condition.

The blades of the added disc(s) thus interact with a flow beneficially pre-aligned as compared to a single disc condition and substantially generate no new wakes for the added disc(s) despite the fact that downstream foils are clearly acting behind and separate from their upstream partners. Such separation is required to realize effective increased inflow stream and equidistant adjacent foil damping. Two considerations show why the range of I.A.s and accompanying axial spacings is functionally broad. Given that swirling wakes are stronger closer to their propagating source, smaller values M.×I.A. (FIG. 6) are indicated. However, consideration of free air flows shows that additional fluid is added to the volume handled in the initial streamtube (FIG. 3), the greater the addition the better. Thus within limits, a larger axial distance between discs offers benefit. (Ignorance of this factor led Prandtl and others to erroneously judge staged systems to be generally inefficient). These two considerations counter each other such that a beneficial range of M.×I.A.s emerges. This is an especially interesting situation for it provides a useful series of interaction regions for a series of relative velocities such that a single fixed array of blades (FIGS. 1 and 2) can be staged to critically interact quite simply and without addition of a complex mechanism, that is of course possible, over a range of conditions (FIG. 6). While blade sections velocities and the like will affect interactions, tests have shown useful values for M.×I.A. to range from under 50° to above 300°.

If we now examine the condition where nN spatially separate blades substantially produce the B.P.F. of an N bladed set we see that this condition may be thought of as a virtual wake absorption. Were the blades not equidistant, relatively increased amplitude would substantially cancel any altered B.P.F. benefit but here the blades are equidistant such that amplitude/sound output is significantly reduced. The improvement realized by such equidistant staging has, in some tests, shown itself to range up to 8 db at the critical B.P.F.s and in general to be observable over a zero relative velocity polar plot and at significant relative velocities. A given array of nN blades can thus be made to both dampen and realize frequency cancellation so as to reduce noise output and blade passing frequency outputs as compared to conventional single disc arrays. Excessively distant spacings will approach non-critical conventional performance while excessively close spacing will tend to conventional performance albeit with possible altered frequency.

Relative thrust benefit at zero to moderate significant relative velocities, loadings, and pitch coarseness, approximately coincides with the acoustic effect noted above. In this regard it should be noted that, due to the interaction amongst the stages, optimally different forward advance ratios from disc to disc should pertain. Thus for static zero relative velocity operation, a relatively fine pitch upstream disc has been found to operate more effectively where the relatively reloaded downstream disc pitch has been coarsened, an increased forward advance ratio of 0.2 blade diameters being useful. While similar sections amongst discs have proven useful it is thus obvious that alterations to blades as a function of the interaction conditions might effect further benefit and be worthwhile. The coarsened downstream disc described above allows the system to rotate at lower velocity for a given output energy level; this provides incremental thrust and acoustic benefit. Inviscid fluid and blade element analysis geometrically calculated, will show those skilled in the art that downstream blade reloading can beneficially occur. In practise the optimal benefit occurs in the near vicity of the intercept of the upstream blade wake with the relevant interacting downstream blade rather than at the exact point of direct intercept. That is significant marginal benefit or optimization occurs where the upstream blade wake is calculated to wash a surface of its downstream partner. In practise the net benefit varies within the region extending to either side of the downstream foil axial location (FIG. 6, #2–6) the geometrically calculated intercept (plus slip allowance), as required being maximal in tests to about one foil thickness (net overwash) and holding to three or more foil thickness to either side of said location. It is therefore reasonable to believe that at high velocities and under certain conditions, a fine pitch downstream should provide additional benefits.

This invention relates to fans and propeller acting in a medium or fluid such a normal air. The potentiating geometry above referred to can be embodied by a wide variety of axial flow staged co-rotating uniform wake producing blade systems with all blades in the system similar. Preferred embodiments will be for free air fans operating at zero relative velocity with residual benefit holding for propellers at significant relative velocities to the point beyond which trade off benefits cease. Modification and application of the embodiment that maintains the critical aspect of the invention as will be obvious to those skilled in the art is included within this specification.

Formulae

The following or like formulae serves to define the critical potentiating geometry whose essence resides in fixing the blade root locations for staged axial flow blades with twist that are substantially uniform wake producing, both with regard to determining axial spacing between stages and index advance angles between blades, said blades being either fixed or movable about their axis and hence commonly referred to as variable pitch blades. (For simplicity sake, a two staged embodiment is cited. This is a practical condition but more stages can be embodied requiring more complex calculation but observing the same principles cited herein with systems whose blade spacings approach symmetry/equidistance and near wash interactions.)

It is to be noted that for the synergy to be effected conditions of: (A) symmetry/equidistance amongst adjacent blades and (B) swirling wake near wash interception between interacting axially separated blades must both be substantially realized.

The first of these conditions is established by equation (A) and the second by equation (B°) or, where appropriate, equation (B$^{v}$) following.

$\boxed{\frac{360°}{nN}}$, establishes the common planform *I.A.* Where $n > 2$ some adjustment to approach equidistance, should be considered. (A)

$\boxed{S_{fa}}$, establishes the *A.S.* or disc separation where $V = 0$, as in fans etcetra. Optimal adjustment is discussed below. (B°)

$\boxed{S_{fa} + S_v}$, establishes the *A.S.* or disc separation where $V \geqq 0$. Optimal adjustment is discussed below. (B$^{v}$)

That is (A)+(B°) or (B$^{v}$) will establish critical blade root locations.

Where:

*N*, is the total number of blades in each stage (1)

*n*, is the total number of blade stages (2)

*I.A.*, is the index advance angle, $\frac{360°}{nN}$ (3)

*M.* × *I.A.*, the virtual interaction angle between blades where *M.*, for $n = 2$, is a reasonably small odd number (1,3,5, etc.) with *M.* × *I.A.* usually less than 315° (4)

$\boxed{S_{fa}}$, the axial shift due to forward advance ratio (*fa*), $\boxed{\frac{M \times fa}{nN}}$ (5)

$\boxed{S_V}$ the axial shift expressed in inches due to significant relative velocity *V* expressed in feet per second (fps) with shaft rotation expressed in revolutions per minute (R.P.M.), $\boxed{\frac{2 \times M. \times I.A. \times V}{\text{R.P.M.}}}$ (6)

Notice, $S_V = 0$ where relative velocity is zero.

Then -

*A.S.* for $V \geqq 0$ (7)

With I.A. established the axial locations in the near vicinity to either side of geometrically established disc stage distances, $S_{fa}+S_V$ establish the critical blade root locations, with A.S. the axial distance center to center between the discs of rotation.

That is, with the upstream blade resultant at the downstream blade interaction angle now determined, a small shift to optimize the wash distance and to allow for slip, if any, will be required. In tests, a net overwash of the downstream blade by the calculated resultant of the upstream blade has proven optimal for fans at V=0. The precise optimal distance may vary with the particular embodiment but the general principles are as determined by the above formulae.

Figure 1:
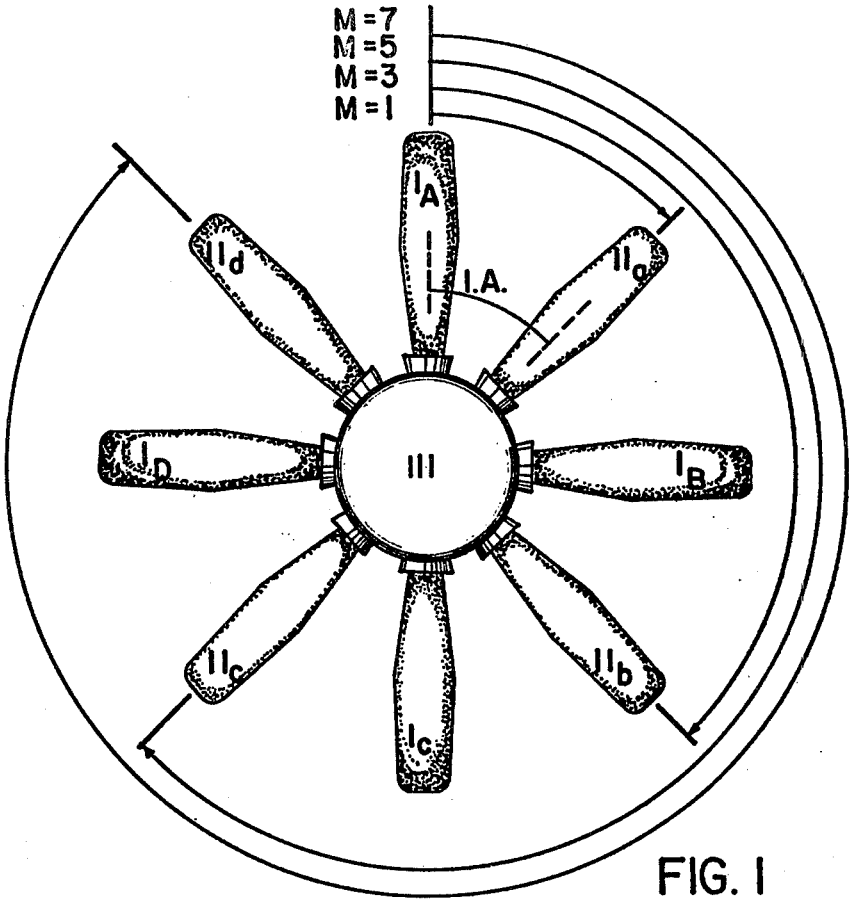
FIG. 1 illustrates a typical, but not limiting case, example showing two stage planform symmetry.

Illustrated is a typical, but not limiting, example of the invention embodying two stages of four blades each. It is required that all stages have the same number of blades. The blades are similar and fixed to a common shaft of rotation III (motor not shown). Optionally some or all of the blade stages may be fitted with conventional variable pitch controls shown schematically by reference character 10. The blades have twist such that all elements of the blade tend to approach uniform advance as they rotate. FIG. 1 shows planform symmetry amongst the upstream blades disc $I_{ABCD}$ and the downstream blades disc $II_{abcd}$, said index advance angle of symmetry given by the formula (360°/nN), where n is the number of stages and N is the number of blades in any stage. Useful interaction angles, as discussed above for values of M, occur at 45°, 135°, 215°, 315°.

Figure 2:
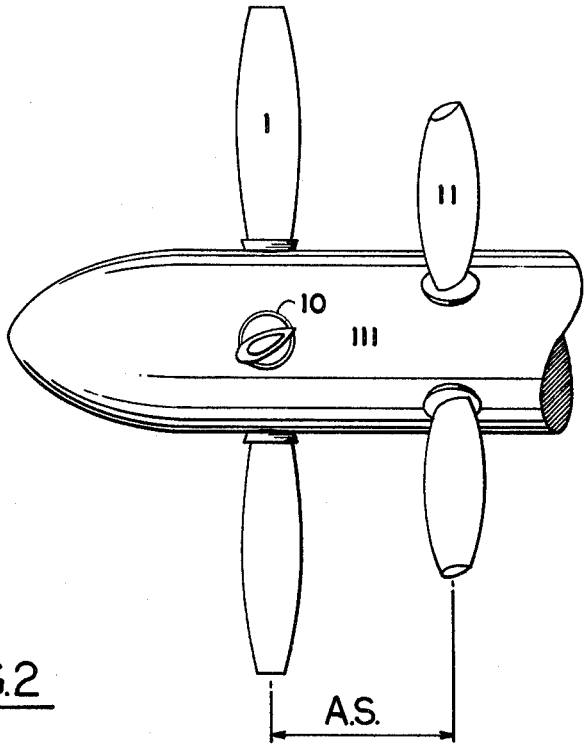
FIG. 2 shows side view of FIG. 1.

FIG. 2 shows a side view of FIG. 1 with axial space between discs I and II center to center determined as per the formula given above.

Figure 3:
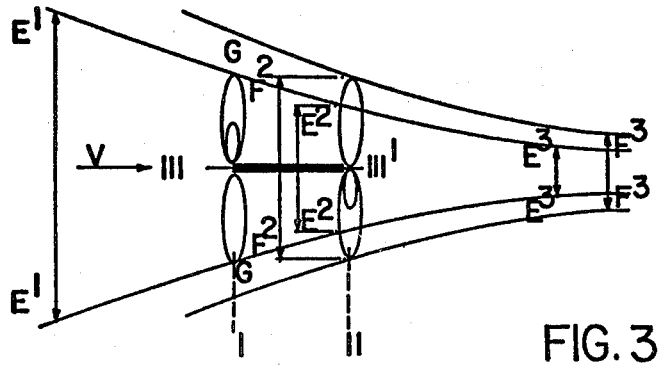
FIG. 3 shows flow analysis of FIG. 2.

FIG. 3, not to scale, shows some streamflow considerations of FIG. 2, III—$III^1$ being the axis of rotation $E^1$—$E^1$ the stream tube diameter of the upstream disc upstream of disc I.

$E^2$—$E^2$ is the diameter of the disc I stream tube acting at disc II blades.

$E^3$—$E^3$ is the diameter of disc I stream tube downstream of disc II. Notice that $F^2$—$F^2$ operates with a stream greater than $E^2$—$E^2$ thus $F^3$—$F^3$ carries more energy than $E^3$—$E^3$. If all blades acted at I the resultant would be the E—E and not the F—F series. However, the inner area of disc II has been unloaded by the resultant of disc I acting over area of disc II with diameter $E^2$—$E^2$. The energy thus freed can be used to power the added load at outer portion of disc II.

The local condition at disc II (especially for disc diameter $E^2$—$E^2$) indicates a desired incremental coarsening of blades for zero to moderate velocities of approximately 0.2 blade diameters over forward advance ratio of blades at disc I. Such and other values have proven useful and further allows the system to carry a given load at lower R.P.M. Additionally a relatively less coarse pitch, as per disc I, is an optional refinement for outer area G of blades at disc II.

Figure 4:
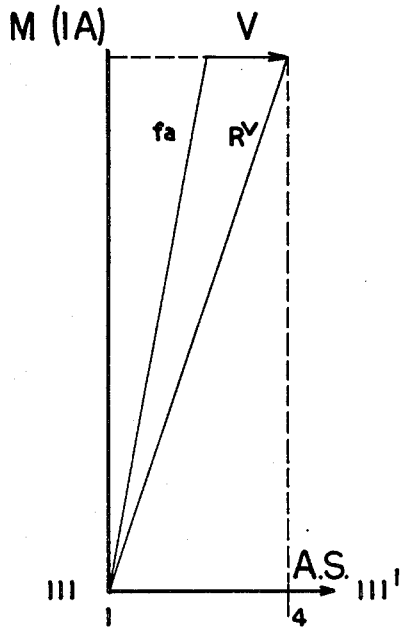
FIG. 4 shows downstream geometric shift of blade wake due to relative velocity consideration acting upon forward advance through a relevant index advance, no slip allowance being considered here.

FIG. 4 shows the wake of a blade at disc I analytically, with the forward advance angle, fa, acting through the index advance angle I.A. at M., shifting downstream due to the relative velocity V. of the stream so that axial space calculation for the intercept of blade wake during rotation through the I.A. may be identified. The significance of such shift is illustrated in FIG. 6.

Figure 5A:
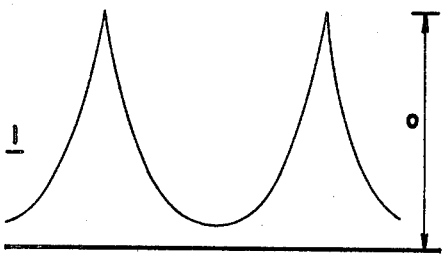
FIGS. 5, *a, b* and *c* show wave form considerations comparing single discs a and b with critical staged conditions c.
Figure 5B:
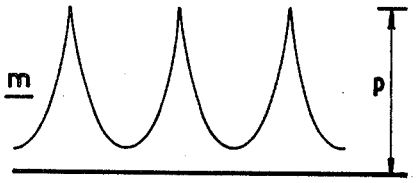
Figure 5C:
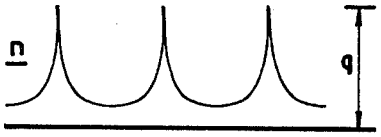

FIGS. 5*a, b* and *c* show three theoretical acoustic curves, (FIG. 5*a*) being a normal single stage configuration of N blades and relatively large amplitude o. This amplitude is reduced to p by the addition of equidistantly spaced blades to the disc so that nN blades act as in curve (FIG. 5*b*). If these additional blades are staged so as to share, or effectively absorb alternate wakes as in the illustration of this invention, then waveforms (FIG. 5*c*) with amplitude q will result. However, area r is virtually absent from 5-*c* as compared to 5-*b*, such area representing energy and hence sound output which is reduced for 5-*c*.

While 5-*m* may be though louder at the wavelength represented by r overall it is quieter than l. Tests show values up to 10 db separation between 5-*n* and 5-*m*, and 5-*m* and 5-*l* respectively. Where the staged configuration lacks the critical features of both interception and symmetry it is both louder and generally less efficient as compared to 5-*n*. Generally it then behaves somewhat like 5-*m* and when blades of disc II are aligned behind-/near disc I blades, the output approaches 5-*l* for loudness.

Rosen and Shipes cited above are examples of asymetrical alignment/near alignment staged systems, here waveforms approach l with alignment and shift towards m showing some signficant area like r with near alignment deviations shown.

FIG. 6 can now be understood as the inviscid analysis plot, not to scale, of the factors given in the above or like formulae that will determine the critical A.S. of FIG. 2. The relative velocity shift at a given index advance angle M.×I.A. is given by weighted arrows at $V^1$ and $V^2$. The shift being nil, V°, for V=0. The vertical scale I.A.s locates disc I and blades A,B,C,D, and graphs the significant index advance angles of FIG. 1. Vertical at II locates blades a,b,c,d, axially spaced along the horizontal A.S. as determined by addition of $S_{fa}+S_V$. Two forward advance ratios $fa^1$ and $fa^2$ are illustrated. Since all blades similarly interact only one blade of disc I will be discussed.

Blade A is shown to beneficially interact geometrically in near underwash with blade c where relative velocity is zero, here $fa^1$ is the resultant, R° or $S_{fa}{}^1$ occurs at location 5 along A.S., a critical interaction near c with M.×I.A.=225°, M=5.

This same embodiment is then shown to shift to $R^1$, where V>0, due to $V^1$ acting at M.×I.A.=135° for a beneficial interaction in near overwash with blade b. If we now consider the same blade root locations but a relatively coarser forward advance ratio for blades in disc I, and greater velocity $V^2$, then blades A and a are in beneficial interaction in near overwash. $S_{fa}{}^2$ at 1 along A.S. plus $S_V$ ($V^2$) identifying intercept at 3 on A.S., blade root II-a being located at 4 along A.S.

It is thus apparent that a single fixed I.A. and axial space can be calculated to provide for a series of beneficial interactions over a range of relative velocities, and be affected by variations in blade pitch and rotational speed. Note: distance (C-b)=(B-b) the common condition amongst adjacent blades, and that blade near wake interceptions may, but need not, be with the immediately adjacent downstream blades. With regard to line A.S.: 0 to 1 is $S_{fa}{}^2$, at M=1, the distance between 2-6 being the region of beneficial intercept, that is useful locations for disc II given that location 3 is known. This region of benefit may vary according to various conditions but in tests has been approximatly 6 foil thickness in extent.

3 and 5 are optimal geometric overwash and underwash near intercept locations with 3 often preferred for acoustic if not for compactness best benefit. No slip allowance calculated has been allowed for here, although such is obvious for large scale applications where viscosity is a consideration.

FIG. 6 thus illustrates the relationships of the critical complex of synergizing factors embodied in FIGS. 1 and 2 as determined by the formulae. While additional complexity may be generally uneconomic these principles may be applied to more than two stages for further marginal benefit. It will, of course, be appreciated that the invention is applicable to both ducted and unducted fans, and in some cases will be employed for only some critical, but not necessarily all, operating conditions.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. An axial flow foil system acting upon a medium such as air comprising in combination two co-rotating foil stages or discs, an upstream foil stage or disc and a downstream foil stage or disc, each foil stage having an equal number of foils, a common shaft, said shaft axially spacing said foil stages to provide clear and substantial disc separation as a function of the downstream location of the wake generated by the upstream foil at the juncture of the substantially intercepted downstream foil, the foils of each stage including roots, said foil stages being fixedly mounted upon said shaft by said roots for common rotation therewith and with one another and in frontal symmetry, the foils or blades of each individual stage having the same pitch and being substantially symmetrically and substantially equidistantly spaced from one another and from the foils of the adjacent foil stage in substantially uniform wake producing relationship so that the interacting, substantially uniform adjacent foil pressures and the upstream foil wakes beneficially interact optimumly with the foils, not necessarily the nearest adjacent ones, of the downstream foil stage, in which virtually continuous air foils are formed of leading edge upstream foils and their cooperating trailing edge downstream foil partners with the separation between these foils provided by the common shaft, that is the substantially common planform index advance angle (I.A.) in the system together with the clear and substantial disc separation (B°) establishes the critical substantially frontal symmetry and the fixed blade root locations upon said shaft.

2. The device according to claim 1 in which the common planform index advance angle I.A. is combined with the disc separation B° under static conditions where $V=0$, plus slip allowance where required.

3. The device according to claim 1 in which the common planform index advance angle I.A. is combined with the stage separation $B^{\nu}$ under dynamic conditions $V>0$, plus slip allowance where required.

4. The device according to claim 2 where I.A. equals (360°/nN) where n is the total number of foil stages and N is the total number of foils in each stage and where B° equals Sfa where Sfa is the axial shift due to the forward advance ratio of the upstream foil (fa) acting through $M.\times I.A.$ the actual wake interaction angle between foils to establish the near intercept region that locates the downstream stage, that is $Sfa=[(M\times fa)/nN]$.

5. The device according to claim 3 where I.A. equals (360°/nN) where n equals the total number of foil stages and N is the total number of foils in each stage and where $B^{\nu}$ equals Sfa plus $S_{\nu}$ where Sfa is the axial shift due to the forward advance ratio (fa) acting through $M.\times I.A.$ the actual wake interaction angle between foils and $S_{\nu}$ is the axial shift expressed in inches due to significant relative velocity V expressed in feet per second with shaft rotation expressed in revolutions per minute where $S_{\nu}=[(2\times M\times I.A.\times V)/R.P.M.]$ with $M\times I.A.$ equalling the virtual interaction angle between foils.

6. The invention according to claims 1, 2 or 3 which includes means to vary the pitch of at least one of said foil stages relative to the other foil stage whereby the relative downstream foil stage is provided with a coarser pitch than the relative upstream foil stage.

7. The invention according to claims 4 or 5 which includes means to vary the pitch of at least one of said foil stages relative to the other foil stage whereby the relative downstream foil stage is provided with a coarser pitch than the relative upstream foil stage.

8. The invention according to claims 1, 2 or 3 which includes means to vary the pitch of at least one of said foil stages relative to the other foil stage whereby the relative downstream foil stage is provided with a finer pitch than the relative upstream foil stage.

9. The invention according to claims 4 or 5 which includes means to vary the pitch of at least one of said foil stages relative to the other foil stage whereby the relative downstream foil stage is provided with a finer pitch than the relative upstream foil stage.

10. The invention according to claim 1 in which the closest approach of the upstream foil wake with the interacting downstream foil is up to at least three foil thicknesses.

11. The invention according to claims 4 or 5 in which the closest approach of the upstream foil wake with the interacting downstream foil is up to at least three foil thicknesses.

12. The invention according to claims 1, 2 or 4 where $V=0$, which includes means to vary the pitch of at least one of said foil stages relative to any other foil stage whereby the relative downstream foil stage is provided with a coarser pitch than the relative upstream foil stage.

13. The invention according to claims 1, 3 or 5 where $V\geqq 0$, which includes means to vary the pitch of at least one of said foil stages relative to any other foil stage whereby the relative downstream foil stage is provided with a coarser pitch than the relative upstream foil stage.

14. The invention according to claims 1 or 3, where $V>0$, which includes means to vary the pitch of at least one of said foil stages relative to any other foil stage whereby the relative downstream foil stage is provided with a finer pitch than the relative upstream foil stage.

15. The invention according to claim 1 in which the relevant upstream foils are situated relative to the cooperating downstream foils whereby the upstream foil wakes interact in an overwash relation with the cooperating downstream foil partners.

16. The invention according to claim 1 in which the relevant upstream foils are situated relative to the cooperating downstream foils whereby the upstream foil wakes interact in an underwash relation with its cooperating downstream foil partners.

17. The invention according to claim 1 in which the relevant upstream foils are situated relative to the cooperating downstream foils whereby the upstream foil wakes interact with its cooperating downstream partners by directly intercepting same.

18. The invention according to claim 1 whereby the fixed foil roots of at least one of the stages is provided with a pitch varying mechanism.

19. The device according to claim 1 in which the foil stages are fixed to the shaft in relation to one another whereby the staged wake interceptions, or near wake interceptions, are combined with substantially equidistant foil phasing.

20. The device according to claim 1 in which the foil stages are fixed to the shaft in relation to one another whereby the staged wake interceptions, or near wake interceptions, are combined with substantially equidistant foil spacing.

21. The device according to claim 1 in which the foil stages are fixed to the shaft in relation to one another whereby the staged wake interceptions, or near wake interceptions, are combined with substantially equidistant foil spacing.

22. An axial flow foil system acting upon a medium such as air and comprising in combination, (a) a shaft (b) a substantially uniform-wake-advancing twisted upstream foil stage secured for rotation to said shaft and including a plurality of substantially symmetrically located foils, including roots, secured to said shaft by said roots, said foils being equidistantly spaced from one another and being equally pitched, in combination with (c) a substantially uniform-wake-advancing twisted downstream foil stage also secured for rotation to said shaft and including a plurality of substantially symmetrically located foils, equal in number to the upstream stage, including roots, secured to said shaft by said roots, said foils also being substantially equidistantly spaced circumferentially from the foils of said upstream stage thereby presenting substantially frontal symmetry whereby (d) said individual foils of said downstream stage beneficially interact optimumly with relevant individual foils of said upstream stage to form a virtually continuous air foil in which the substantially common planform index advance angle in the system, together with the said disc separation establishes said substantial frontal symmetry and the blade root locations upon said shaft.

23. The system according to claim 22 which includes means to vary the pitch of at least one of said foil stages relative to the other foil stage whereby the relative downstream foil stage is provided with a coarser pitch than the relative upstream foil stage.

24. The system according to claim 22 which includes means to vary the pitch of at least one of said foil stages relative to the other foil stage whereby the relative downstream foil stage is provided with a finer pitch than the relative upstream foil stage.

25. The system according to claim 22 under static conditions where $V=0$, which includes means to vary the pitch of at least one of said foil stages relative to any other foil stage whereby the relative downstream foil stage is provided with a coarser pitch than the relative upstream foil stage.

26. The system according to claim 22 under dynamic conditions where $V>0$, which includes means to vary the pitch of at least one of said foil stages relative to any other foil stage whereby the relative downstream foil stage is provided with a coarser pitch than the relative upstream foil stage.

27. The system according to claim 22 under static conditions where $V=0$, which includes means to vary the pitch of at least one of said foil stages relative to any other foil stage whereby the relative downstream foil stage is provided with a finer pitch than the relative upstream foil stage.

28. The system according to claim 22 under dynamic conditions where $V>0$, which includes means to vary the pitch of at least one of said foil stages relative to any other foil stage whereby the downstream foil stage is provided with a finer pitch than the relative upstream foil stage.

* * * * *